US011779097B1

(12) United States Patent
Sokolowski

(10) Patent No.: US 11,779,097 B1
(45) Date of Patent: Oct. 10, 2023

(54) MODULAR SPACER DEVICE FOR AIRFLOW BETWEEN A USER AND A WEARABLE BAG

(71) Applicant: Brice H Sokolowski, Austin, TX (US)

(72) Inventor: Brice H Sokolowski, Austin, TX (US)

( * ) Notice: Subject to any disclaimer, the term of this patent is extended or adjusted under 35 U.S.C. 154(b) by 1 day.

(21) Appl. No.: 17/681,448

(22) Filed: Feb. 25, 2022

Related U.S. Application Data

(60) Provisional application No. 63/248,879, filed on Sep. 27, 2021.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 2003/122; A45F 2003/125
See application file for complete search history.

(56) References Cited

U.S. PATENT DOCUMENTS 11,172,753 B2 * 11/2021 Picking ..... A45F 3/14
2004/0134955 A1 * 7/2004 Williams ..... A45F 3/04 224/644
2004/0173656 A1 * 9/2004 Seong ..... A45F 3/04 224/644
2005/0040684 A1 * 2/2005 Yoshiguchi ..... A45F 3/12 297/228.13
2005/0138717 A1 * 6/2005 Le Gal ..... A45F 3/04 2/102
2010/0116861 A1 * 5/2010 Burrowes ..... A45F 3/04 224/633
2017/0181529 A1 * 6/2017 Tatsumi ..... A45F 3/047
2020/0196737 A1 * 6/2020 Chan ..... A45F 3/12

FOREIGN PATENT DOCUMENTS

JP H1189635 A * 4/1999
KR 200171380 Y1 * 3/2000
WO WO-0115574 A1 * 3/2001 ..... A47C 21/046

* cited by examiner

*Primary Examiner* — Scott T McNurlen
(74) *Attorney, Agent, or Firm* — Plager Schack LLP; Mark H. Plager; Kara K. Verryt

(57) ABSTRACT

A spacer device with a modular, truss-like structure for creating airflow between a user and a wearable bag may include a first panel having a first substantially planar web-like body, a second panel spaced from the first panel, the second panel having a second substantially planar web-like body, a plurality of modular supports extending between the first panel and the second panel, such that a distance between the first panel and the second panel is substantially uniform and adjustable, and a plurality of extension loops extending from an outer surface of the spacer device, the plurality of extension loops each being sized to accommodate placement of a strap therethrough.

8 Claims, 5 Drawing Sheets

MODULAR SPACER DEVICE FOR AIRFLOW BETWEEN A USER AND A WEARABLE BAG

RELATED APPLICATION

This application claims priority to provisional patent application U.S. Ser. No. 63/248,879 filed on Sep. 27, 2021, the entire contents of which is herein incorporated by reference.

BACKGROUND

The embodiments described herein relate generally to accessories for wearable bags, such as backpacks, and, more particularly, to an airflow spacer device removably attached to a wearable bag to allow for airflow between the wearable bag and the wearer's back.

Backpacks or other wearable bags are worn on a user's back for various reasons, including hiking, school, military purposes, and the like. It is common, particularly in hot or humid weather, for a user's back to become sweaty and hot when wearing a backpack. While some backpacks and spacers include foam mesh that absorbs sweat from the wearer, this does not lower the temperature of the wearer's back or allow the sweat condensation to evaporate. The mesh does allow for small pockets of air to flow from the user's back. Rather, these types of backpacks attempt to absorb as much sweat as possible to limit the discomfort. Over time, this type of pack panel can smell due to prolonged absorption of sweat.

While some backpacks or rucksacks may have an attached frame that space the backpack from the user, the existing frames tend to be permanently attached to the bag, meaning that they are not interchangeable with other backpacks the user may also own. Backpacks also use curved frames to allow some space between the user and the pack; however, this design does not allow airflow to freely pass through the space and therefore heat is still trapped. Additionally, they tend to either be so stiff that they are not comfortable or too soft, resulting in the frame collapsing in on itself and preventing airflow. Existing backpacks and spacers allow no or minimal adjustments to the space between the user and the backpack or rucksack, thereby limiting the user's personal preferences for amount of air flow, comfort, or back support.

Therefore, what is needed is a spacer device that does not use mesh and small air pockets but rather allows for much larger pockets that allow air to touch more of the person's back and therefore produce a better airflow between the user and pack. Additionally, this device can removably or interchangeably attach to a wearable bag, wherein the spacer device has a truss-like or web-like structure that spaces the user's back from the device and allows for the spacer to conform to the shape of a user's back, even with movement of the user, to produce larger pockets of airflow without restricting airflow between the user and the backpack. A design that has no mesh on the back would allow for larger pockets of air to flow between the user and the backpack. Ideally, the spacer device may be able to adjust to the user's personal comfort and back support desires.

SUMMARY

Some embodiments of the present disclosure include a spacer device with a modular, truss-like structure for creating airflow between a user and a wearable bag. The spacer device may include a first panel, a second panel spaced from the first panel, a plurality of modular supports extending between the first panel and the second panel, such that a distance between the first panel and the second panel is substantially uniform and adjustable, and a plurality of extension loops extending from an outer surface of the spacer device.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a spacer device used to provide airflow between a user and a wearable bag and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-9, some embodiments of the present disclosure include a spacer device that is attached to, such as removably attached to, permanently attached to, or integrated into, a surface of a wearable bag, such as backpack 26 or bag designed to be positioned against a user, wherein the spacer device comprises a modular, truss-like structure that conforms to the shape of the user's back while maintaining distance between the user and the wearable bag allowing for airflow between the user and the wearable bag.

More specifically, the spacer device may comprise a first panel 10 spaced from a second panel 14 and a plurality of supports 12 extending between the first panel 10 and the second panel 14, such that the distance between the first panel 10 and the second panel 14 stays substantially uniform, wherein each of the plurality of supports 12 may be adjusted to increase or decrease the space between the first panel 10 and the second panel 14. In embodiments, the first panel 10 and the second panel 14 may each comprise a substantially planar web-like body with a plurality of orifices, such as hexagonal and diamond-shaped orifices, extending therethrough. The device may further comprise a plurality of arms or loops extending from edges of the spacer device such that the spacer device may be removably engaged with a wearable bag, such as backpack 26, by passing the straps through the arms or loops.

Figure 1:
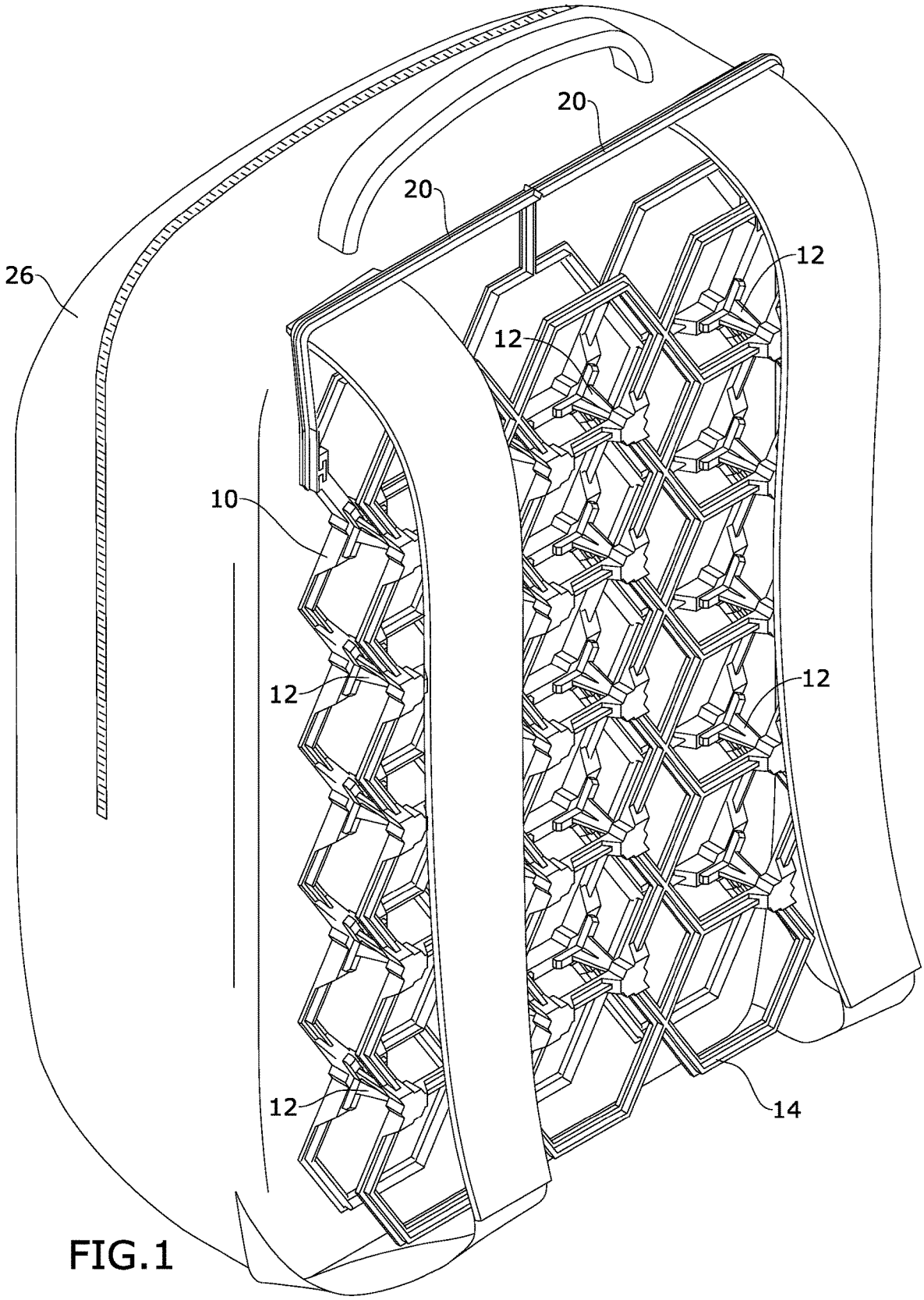
FIG. 1 is a perspective view of one embodiment of the present disclosure, shown in use.
Figure 2:
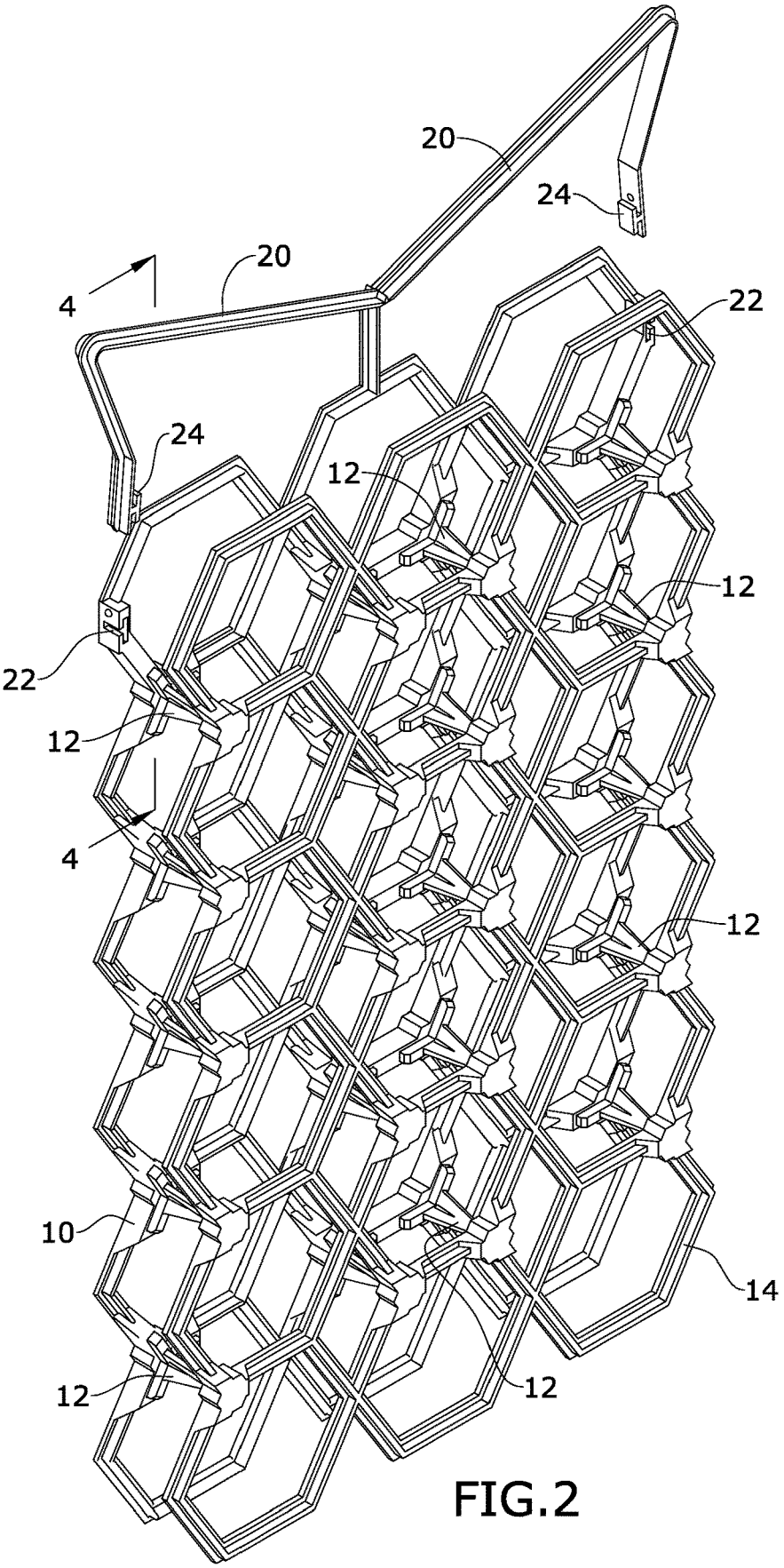
FIG. 2 is a perspective view of one embodiment of the present disclosure.
Figure 3:
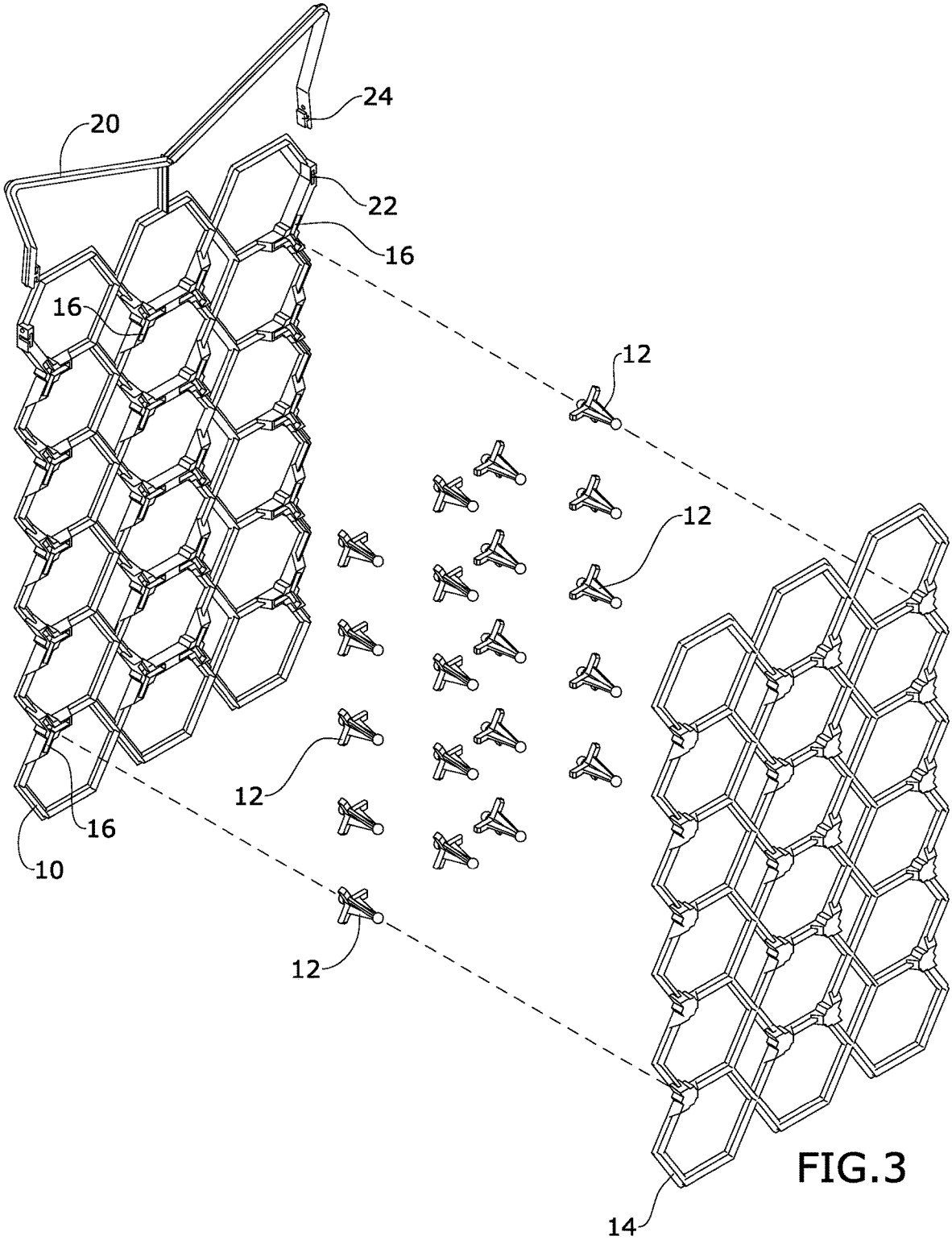
FIG. 3 is an exploded view of one embodiment of the present disclosure.
Figure 4:
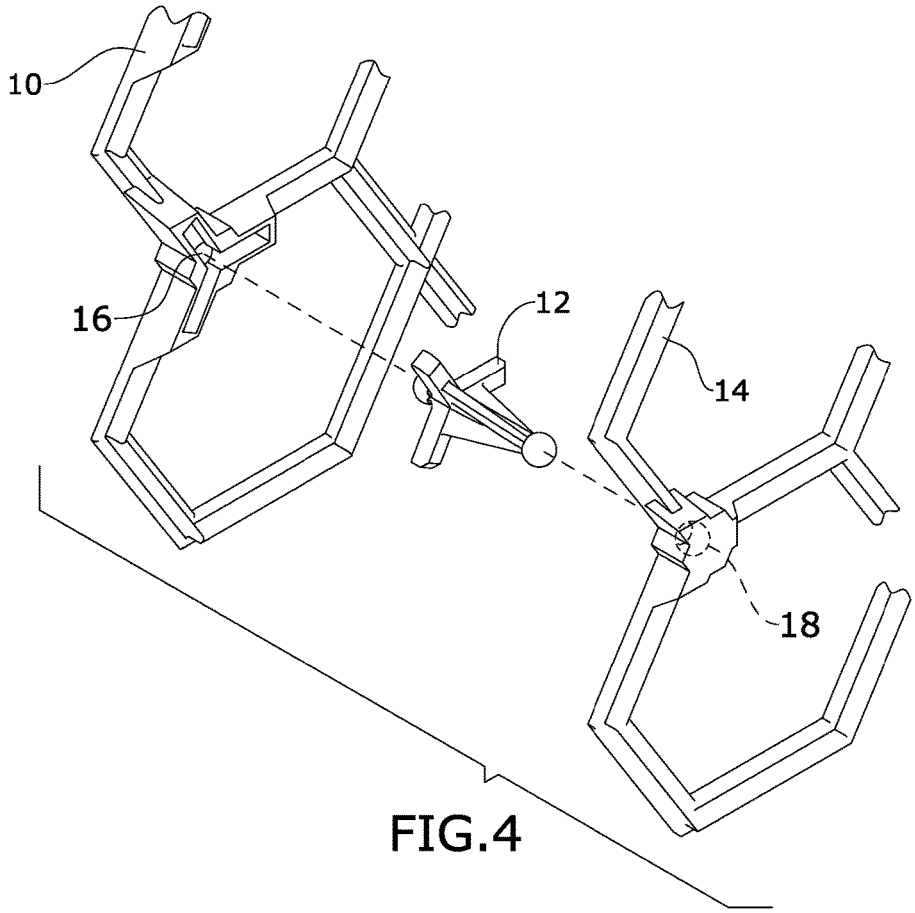
FIG. 4 is a detailed perspective view of one embodiment of the present disclosure.
Figure 5:
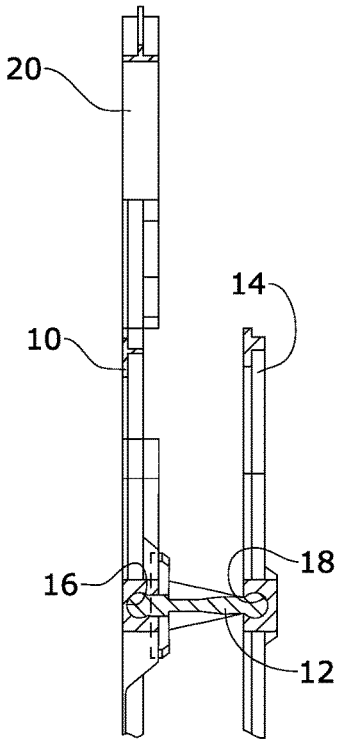
FIG. 5 is a section view of one embodiment of the present disclosure, taken along line 4-4 in FIG. 2.

In embodiments, and as shown in FIG. 3, the first panel 10 may comprise a planar web-like body created by the interconnection of a plurality of hexagons and diamonds. The first panel 10 may comprise a plurality of support slots 16 extending therein. For example, the support slots 16 may each be positioned at the intersection of adjacent hexagons. As shown in FIG. 4, each of the support slots 16 may comprise three elongate slots converging at a central region, wherein the central region may extend deeper into the first panel 10 and may be substantially sphere-shaped. The spacer slots 16 may be designed to engage with a first end of the support 12.

The plurality of arms or loops may also be attached to the first panel 10. For example, and as shown in FIG. 3, the first panel 10 may comprise a pair of arms 20 permanently attached to a central region of a top edge of the first panel 10. Each arm 20 may extend away from one another toward a respective, distal outer edge of the first panel 10, wherein the end of each arm 20 distal from the central region of the first panel may comprise a connector designed to removably engage with a complementary connector on the distal outer edge of the first panel 10. In a particular embodiment, the connector attached to the distal end of each arm 20 may comprise a pale connector 24 designed to be accommodated within a female connecter 22 on the first panel 10. Thus, each of the arms 20 may be openable and closeable with respect to the first panel 10, such that straps from the wearable bag may be inserted therein. While not shown in the Figures, the location of the arms may vary depending on the positioning of the straps on the wearable bag. Moreover, some embodiments of the spacer device may comprise more or fewer arms, again, depending on the design of the wearable bag to which the spacer device is to be connected.

Figure 6:
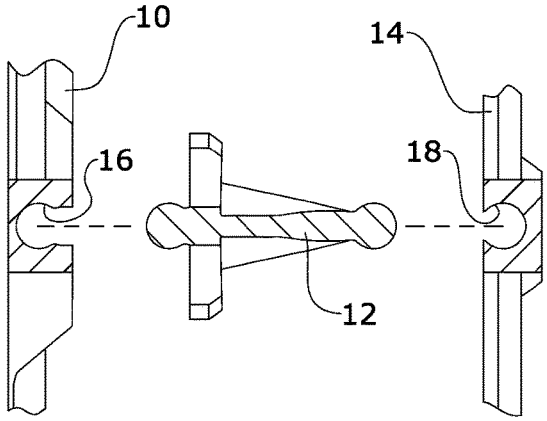
FIG. 6 is a section view of one embodiment of the present disclosure, taken along line 4-4 in FIG. 2 and showing the support 12 exploded.
Figure 7:
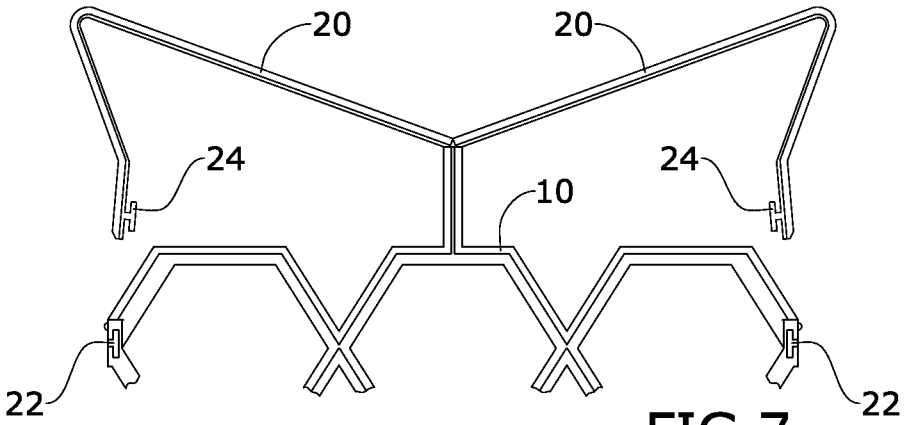
FIG. 7 is a detail view of one embodiment of the present disclosure, showing arms 20 open.
Figure 8:
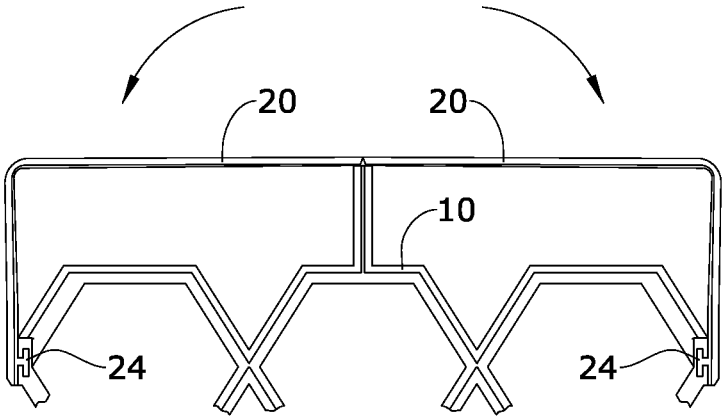
FIG. 8 is a detail view of one embodiment of the present disclosure, showing arms 20 closed.

As further shown in the Figures, the second panel 14 may have a structure similar to that of the first panel 10, wherein the second panel 14 may comprise a plurality of interconnected hexagons and diamonds. At the intersection of each adjacent hexagon, the second panel 14 may comprise a support socket 18 extending therein, as shown in FIG. 6. The support socket 18 may be designed and sized to engage with a second end of the support 12.

In embodiments, each of the plurality of supports 12 may comprise a device having a pyramid-like shape, wherein a first end of the support 12 comprises base legs with a base ball extending therefrom, the base legs and base ball sized to removably engage with the support slot 16 on the first panel 10. A wall may extend upward from each base leg, wherein the wall tapers in width as it moves away from the base legs, wherein the walls converge at a ball on the second end of the support 12. The ball may be sized to engage with the support socket 18 on the second panel 14. In other words, the supports 12 may each comprise a central support with a plurality of wings extending outward therefrom proximal to a first end of the central support. Each end of the central support may comprise, for example, a ball designed to removably engage with sockets on each of the first panel 10 and the second panel 14.

Figure 9:
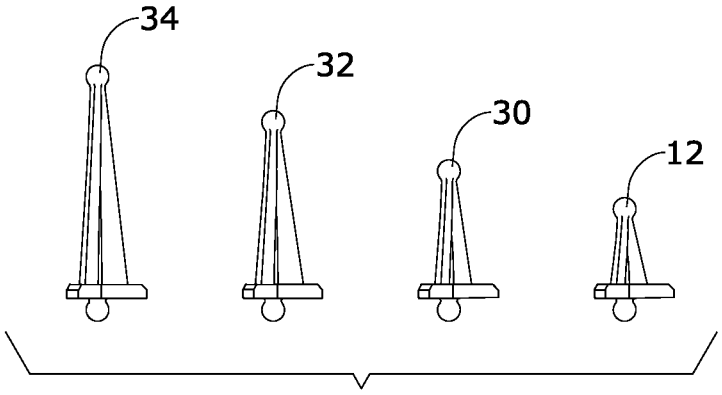
FIG. 9 is a front view of alternate embodiments of the support.

As shown in FIG. 9, the support may vary in length to provide for larger or smaller space between the first panel 10 and the second panel 14 during use of the spacer device. For example, there may be a largest support 34, that provides for the largest distance between the first panel 10 and the second panel 14, intermediate sized spacers 32, 30 that provide for alternate distances between the first panel 10 and the second panel 14, and finally a smallest support 12 that provides for the smallest distance between the first panel 10 and the second panel 14. To use the support 12, the base of the support 12 is simply inserted into the support slot 16 on the first panel 10 and the second end of the support 12 is inserted into the support socket 18 on the second panel.

While the above description and the Figures show that the first panel 10 includes the support slot 16 and the second panel 14 includes the support socket 18, this may be reversed such that the second panel 14 includes the support slot 16 and the first panel 10 includes the support socket 18. Similarly, while the Figures and the above description show that the first panel 10 includes the plurality of arms, the arms or loops may extend from the second panel 14 instead.

The spacer device of the present disclosure may be made using any suitable or desirable materials, such as a rubber material. In embodiments, the plurality of supports 12 may comprise a material suitable for preventing the compression of the second panel 14 against the first panel 10, thus maintaining the distance between the first panel 10 and the second panel 14, while simultaneously allowing the first panel 10 to conform to the shape of a user's back. In some embodiments, the plurality of supports 12 may provide for an adjustable distance between the user and the backpack. For example, in embodiments, the plurality of supports 12 may be interchangeably engaged with each of the first panel 10 and the second panel 14, such that the support slots 16 may have spacers 12 that can be replaced and interchanged with alternate embodiments of the spacers 30, 32, and 34 such that the space between the user and backpack may be adjusted.

Due to the structure of the spacer device, air may freely flow between a user's back and the wearable bag, naturally evaporating sweat and cooling the user's back, dispersing heat trapped between the bag and the user, unlike conventional wearable bags and mesh frame spacers.

To use the spacer device of the present disclosure, the device may be attached to the straps, causing the spacer device to sit against the back panel of the backpack. The user may then put the backpack on, and the spacer device will allow for airflow between the user and the backpack.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A spacer device with a modular, truss-like structure for creating airflow between a user and a wearable bag, the spacer device comprising:

a first panel comprising a first substantially planar web body;

a second panel spaced from the first panel, the second panel comprising a second substantially planar web body;

a plurality of modular supports extending between the first panel and the second panel, such that a distance between the first panel and the second panel is substantially uniform and adjustable; and a plurality of extension loops extending from an outer surface of the spacer device, the plurality of extension loops each being sized to accommodate placement of a strap therethrough, wherein each support of the plurality of modular supports comprises a central support, a plurality of tapered walls extending outward from the central support, a base ball on a first end of the central support proximate to the widest part of each wall, and a ball on the second end of the central support.

2. The spacer device of claim 1, wherein:

the first panel comprises a plurality of interconnected hexagons and diamonds;

a support slot extends into the first panel at an intersection of adjacent hexagons; and the support slot is sized to accommodate insertion of a first end of a support from the plurality of modular supports therein.

3. The spacer device of claim 1, wherein:

the second panel comprises a plurality of interconnected hexagons and diamonds;

a support socket extends into the second panel at an intersection of adjacent hexagons; and the support socket is sized to accommodate insertion of a second end of a support from the plurality of modular supports therein.

4. The spacer device of claim 1, wherein each support of the plurality of modular supports are removably engaged with both the first panel and the second panel.

5. The spacer device of claim 1, wherein the plurality of extension loops comprises a pair of arms extending from the first panel.

6. The spacer device of claim 5, wherein each arm of the pair of arms comprises:

a first arm end fixedly attached to the first panel; and a second arm end removably engaged with the first panel.

7. The spacer device of claim 6, wherein the second arm end comprises a male connector designed to engage with a female connector on the first panel.

8. A spacer device with a modular, truss-like structure for creating airflow between a user and a wearable bag, the spacer device comprising:

a first panel comprising a first substantially planar web body;

a second panel spaced from the first panel, the second panel comprising a second substantially planar web body;

a plurality of modular supports extending between the first panel and the second panel, such that a distance between the first panel and the second panel is substantially uniform and adjustable; and a plurality of extension loops extending from an outer surface of the spacer device, the plurality of extension loops each being sized to accommodate placement of a strap therethrough, wherein each support of the plurality of modular supports comprises a central support, a plurality of tapered walls extending outward from the central support, a base on a first end of the central support proximate to the widest part of each wall, and a second base on the second end of the central support.

* * * * *